US006336858B1

(12) United States Patent
Yoseloff

(10) Patent No.: US 6,336,858 B1
(45) **Date of Patent: *Jan. 8, 2002**

(54) METHOD OF PLAYING A SIMPLIFIED MAH JONGG WAGERING GAME

(75) Inventor: Mark L. Yoseloff, South Glastonbury, CT (US)

(73) Assignee: Shuffle Master, Inc., Eden Prairie, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/815,841

(22) Filed: Mar. 12, 1997

(51) Int. Cl.[7] ..... A63F 9/24

(52) U.S. Cl. ..... 463/13; 463/17; 273/292; 273/306

(58) Field of Search ..... 273/292, 303, 273/306, 309, 274; 463/11, 12, 13, 16, 17

(56) References Cited

U.S. PATENT DOCUMENTS 4,147,363 A * 4/1979 Lee et al.
4,530,499 A 7/1985 Breslow et al. ..... 273/1 GC
5,224,706 A 7/1993 Bridgeman et al. ..... 273/85 CP
5,397,128 A * 3/1995 Hesse et al.
5,522,595 A * 6/1996 Wong
5,531,441 A 7/1996 Dabrowski et al. ..... 463/12

FOREIGN PATENT DOCUMENTS

JP 40421239 1/1992
JP 40505706 1/1993

OTHER PUBLICATIONS

D. Kohnen, Maj–Jongg, Basic rules and Strategies, Sterling Publishing Co., Inc. 1998 (originally published and copyright 1996 by Falken Publishing pp. 4–13).

* cited by examiner

*Primary Examiner*—Michael O'Neill
(74) *Attorney, Agent, or Firm*—Jennifer K. Farrar

(57) ABSTRACT

A method of playing a video wagering game is disclosed. The method includes providing a set of tiles having a set of suited tiles, and at least one non-numerical tile. Each tile in the set is marked sequentially with a numerical value. Upon placing a wager, 3X+2 cards are dealt to the player, where X is an integer. Any cards which are dealt and which are non-numerical are set aside for scoring and replaced with another card. The player may optionally discard one tile at a time, which is replaced in turn with another randomly selected tile, up to a maximum allowable number of discarded tiles. If the resulting player hand is a preselected combination, the player wins a payout. If the player receives any non-numerical tiles during play of the game, the payout is enhanced.

31 Claims, 4 Drawing Sheets

METHOD OF PLAYING A SIMPLIFIED MAH JONGG WAGERING GAME

BACKGROUND OF THE INVENTION

The present invention relates to wagering games. In particular, the present invention relates to video wagering games which employ video representations of tiles having symbols disposed on a surface of the tiles.

Wagering games which employ tile sets are well known. Mah Jongg is an example of one of the more popular live tile games. Mah Jongg is the national game of China, and is sometimes referred to as the Chinese Game of the Four Winds. Although the origins of the game are uncertain, it is believed that Mah Jongg was originally played by the ruling class in China and dates back to the time of Confucius. As with many other games, the rules of play of Mah Jongg have changed over time. For example, in the Seventeenth Century, a version of Mah Jongg was played which utilized a set of 118 tiles. Over the years, the number and type of tiles changed until eventually there were 160 tiles in the set.

Mah Jongg in its present form has been played for about one hundred years. A set of 144 tiles has been used for the last one hundred years, and the same number of tiles is used today to play the most popular form of the game. Each set of tiles includes three categories of tiles. They are suited, honor and flower tiles. There are three types of suits; namely bamboo, numbers and dots. Each suit consists of nine tiles, each of which is assigned a numeric value. The bamboo and dot suits are assigned a value from one to nine, and the numbers suit is assigned values between 10,000 and 90,000. Although the numbers suit has a higher value, the tiles are scored as if they were assigned a value between 1 and 9.

There are four sets of each of the three suits, for a total of 108 suited tiles. Additionally, there are twenty eight honor tiles. The honor tiles include direction tiles (wind tiles) and dragon tiles. There are four each of a North Wind, South Wind, East Wind and West Wind tile. There are also four each of Green Dragon tiles, Red Dragon tiles, and White Dragon tiles. The remaining tiles in the set include eight flower tiles.

Mah Jongg is played by four players. To begin the game, one each of the North, South, East and West Wind tiles are placed face down on the table. Each player takes a seat. Each of the four seats is designated North, South, East and West. The person who sits in the East seat rolls the dice. The East player is assigned the numbers 5 and 9. The person opposite him is assigned 7 and 11. The person to the right of the East player is assigned 6 and 10, and the person opposite that player is assigned 8 and 12. The number which is randomly selected by the throw of the dice determines who will draw the first tile. The remaining tiles are drawn in order moving clockwise from the first person who drew, until each of the four tiles are picked up. The person who draws the East tile takes the chair of the person who threw the dice. Then the south, west and north players take their position around the table, rotating clockwise from the East position.

The tiles are shuffled face down, and are arranged face down in four lines, stacked two tiles high. The entire arrangement is in the shape of an outline of a large square. One of the tiles is removed from the game, and the four wind tiles which were used to determine the seating arrangement also remain out of play.

Next, the East player casts the dice to determine who will be the banker. The banker is determined in a manner similar to that of determining who the East player will be, except that it is customary to subtract one from the number rolled on the dice. For example, if a ten is rolled, East, who is assigned numbers five and nine is the banker for that game. There are sixteen games in all, except when the banker wins his own game. Then that player continues to serve as banker until another person wins. The number of times the banker must change per game is therefore sixteen times.

The method of scoring the game is complex. Although some of the scoring rules will be outlined below for illustration, this description is by no means intended to provide a comprehensive outline of the current rules of play of Mah Jongg.

The dealer distributes thirteen tiles to each player according to a complex dealing procedure which will not be described in detail herein. The East player receives fourteen tiles, and is the first to play his hand. Play begins when the East player discards his first tile.

The object of the game is to collect one pair (referred to as a "pillow"), plus runs of a suit and three of a kind of a suit. A run must comprise three or more tiles of one suit in numerical order. It is not necessary to have both runs and threes of a kind in a hand in order to "go out. " For example, one might go out with four sets of three of a kind, plus a pair, for a total of fourteen tiles. A player must use the last tile he draws, without discarding, in order to go out. Generally, players draw and then discard in order, except when a player is permitted to pick up a discarded tile. In those instances, it is permissible to play out of order.

Certain types of runs have a higher scoring value than others. If a player draws a flower tile, it is declared, and the tile is set aside. The player then draws another replacement tile. The flower tiles change the scoring of the hand. The amount won by the player who has gone out is determined by the point values of both the winning hand and the losing hands. Points earned by or lost from the dealer count double. It typically takes at least an hour for four players to conclude a game of Mah Jongg.

The overview provided above is only intended to illustrate the complexity of the Mah Jongg game, as well as emphasize that four players are required, and that the game takes some time to play.

Mah Jongg is known as a gambling game. Point values are assigned to various tile combinations, and wagers are resolved according to the point values of each hand at the conclusion of each game.

A different game which utilizes Mah Jongg tiles is a live casino table game described in Wong U.S. Pat. No. 5,522,595. This patent describes a method of playing a tile game which includes dealing three tiles each to the players, the banker/player and to the dealer. Players take turns being the banker. One tile is then discarded. No additional tiles can be drawn. The highest ranking two tile hand wins. The banker bets an amount which will cover all of the remaining player bets. The game can be played with a thirty two tile set including three suits of tiles having a value of one to nine, two "second character" tiles, and three "third character" tiles. The character tiles have no numerical value, but are part of the hand. Character tiles have a point value when the hand is scored.

It would be desirable to provide a game with some of the familiar aspects of Mah Jongg but with simplified rules so that the game could be learned in a matter of minutes. It would also be desirable to offer a video wagering game available for play in a casino environment, to add fun and excitement to the game. An electronic video game would advantageously score hands, and eliminate the need for shuffling and handling tiles, which slows the play of the game.

SUMMARY OF THE INVENTION

The present invention is a novel method of playing a wagering game. A number equal to 3X+2 tiles are dealt to a player, where X is an integer. A set of tiles are provided having at least one set of suited tiles and at least one non-numerical tile. Each suited tile bears an indication of suit and a numerical value. The numerical values of each tile in the suit are numbered in sequence.

The player begins play by placing a wager. The player is dealt the tiles. He may optionally select a tile to be discarded, which is replaced with another tile. This procedure is repeated until the number of tiles replaced reaches a maximum allowable number of tiles or until the player elects not to make any additional discards and draws. At any time during play of the game, if a player is dealt a non-numerical tile, the tile is set aside and replaced with another tile. Certain combinations of tiles are designated in advance to be winning combinations. If the player's hand is one of these winning arrangements of tiles, the player is paid a predetermined amount.

DETAILED DESCRIPTION OF THE PREFERRED EMBODIMENT

A novel method of playing a video wagering game employing a number of video representations of tiles bearing symbols is described below.

Figure 1:
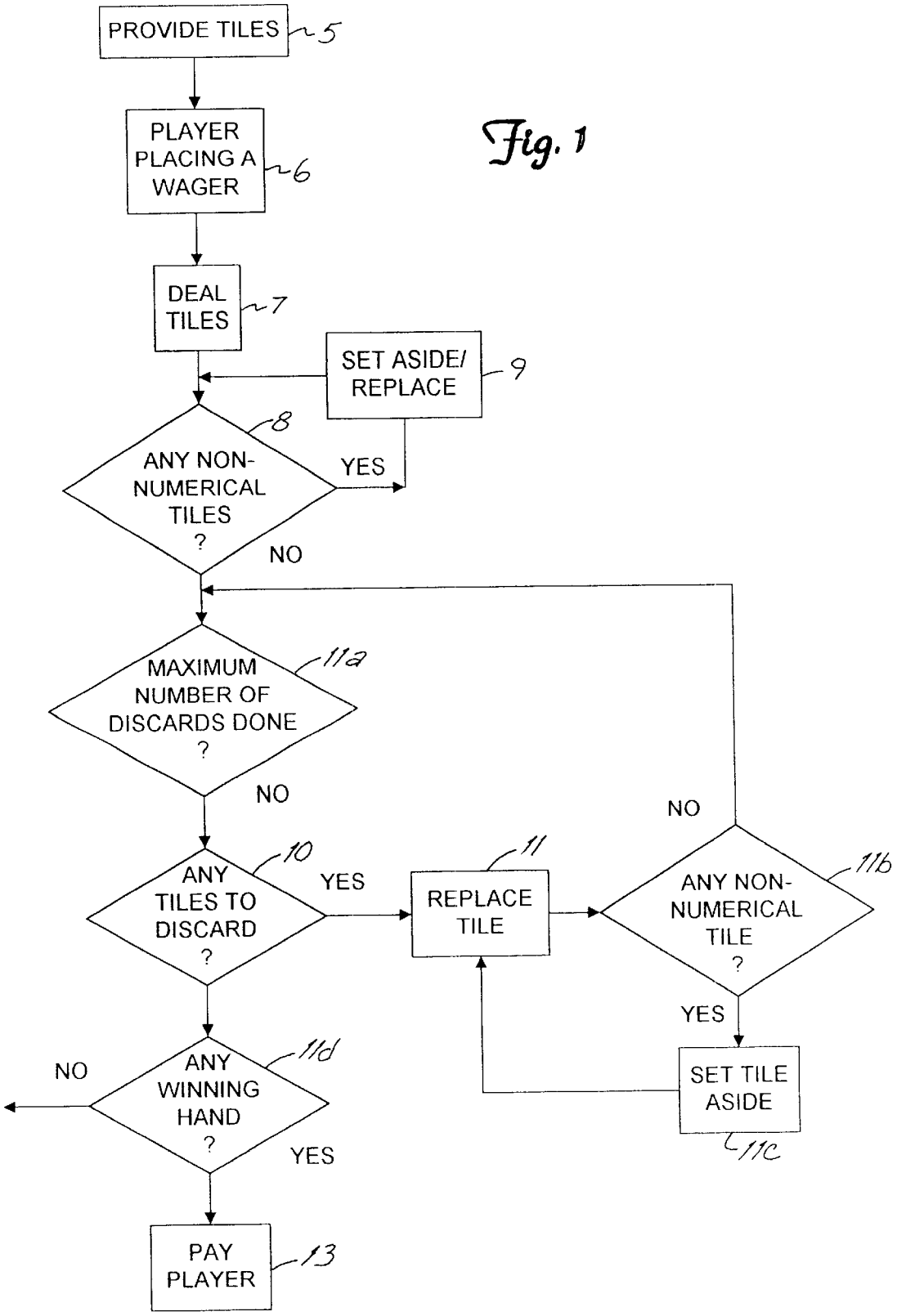
FIG. 1 is a flow diagram illustrating a preferred embodiment of the method of the present invention.

Referring to FIG. 1, in a first preferred embodiment of the game of the present invention, a set of tiles 5 are provided. The set of tiles includes at least one set of suited tiles and at least one non-numerical tile. Each suit includes a number of tiles that are marked to designate the suit, and are sequentially numbered.

A player places a wager 6 to participate in the game. A number of tiles are dealt 7 to the player, equal in number to 3X+2, wherein X is an integer. If any non-numerical tile 8 is drawn, the tile is set aside and replaced 9 with a new tile. The replace 9 procedure is repeated if additional non-numerical tiles are drawn.

A player may discard one tile at a time, 10 which is replaced 11 until a maximum number of discards 11*a* are taken. If any non-numerical tiles are drawn, 11*b*, they are set aside 11*c* and replaced 11. If the player achieves a winning hand 11*d* he receives a 13 payout. At the conclusion of play, the player holds a hand of 3X+2 tiles of numerical value. The player is free to hold without discarding and have his hand scored. If a predetermined arrangement of tiles is achieved, the player is paid 13 a predetermined amount.

Preferably, four identical Mah Jongg "bamboo" suits are provided, as well as two "flower" tiles as the preferred set. In the most preferred embodiment, X is equal to one. That is, the number of tiles in each hand is five. The maximum allowable number of tiles that can be discarded is two.

According to the present invention, the preferred predetermined winning arrangements of tiles are: three ones and two nines, two ones and three nines, any three of a kind with a pair of twos, fives or eights, any three of a kind with any pair, any run with a pair of twos, fives or eights, and any run with any pair.

The preferred payout amount is determined according to the most preferred payout schedule:

| Combination | No flowers | 1 Flower | 2 Flowers |
|---|---|---|---|
| two 9's and three 1's | 25 | 50 | 250 |
| three 9's and two 1's | 25 | 50 | 250 |
| any three of a kind with a pair of 2's, 5's or 8's | 7 | 14 | 28 |
| any three of a kind and a pair | 4 | 8 | 16 |
| any run with a pair of 2's, 5's or 8's | 2 | 6 | 12 |
| any run and any pair | 1 | 3 | 6 |

A second most preferred payout schedule can be applied when the player places the maximum allowable bet. In this instance, the pay table is identical, except that for combinations of two 9's and three 1's, and combinations of three 9's and two 1's, and when two flower tiles are drawn, the game pays 800 for 1.

Another preferred method of the present invention is a video game. The game includes providing a video wagering machine with a CPU (Central Processing Unit) programmed to display video representations of playing pieces, such as tiles, cards, or dominos, for example. Although the invention is not intended to be limited to displaying video representations of playing tiles, a preferred mode of play includes playing the wagering game of the present invention with video representations of certain types of Mah Jongg tiles. For purposes of this disclosure, the term "tile" refers to video representations of tiles, cards, dominos or other playing pieces. The video representations of a set of tiles of the present invention includes a plurality of suited tiles. What is meant by "suited" for purposes of this disclosure is video representations of tiles bearing symbols which indicate that the tiles are marked in a manner to show that each tile in the set is from the same suit, and also including an indication of a numerical value.

The video representations of the suited tiles includes a plurality of tiles that are sequentially ordered and marked. In the preferred video method of play, a video representation of a single thirty-eight tile set of tiles is provided. It is to be understood that all references to "tiles" in this disclosure refer to video representations of tiles, not actual physical tiles. Four identical sets of "bamboo" suited Mah Jongg tiles are provided as part of the set. There are nine numbered tiles in each suit, numbered one through nine. In addition to the suited tiles, the method of the present invention includes utilizing a video representation of a set of tiles which includes a plurality of non-numerical tiles. The non-numerical tile video representations are used only to enhance the point value of winning hands achieved with the suited tiles, and do not have a point value.

According to the preferred method, the CPU is programmed to "deal" a plurality of tiles to the player. The screen display shows 3X+2 video representations of tiles, where X is an integer equal to or greater than zero. Preferably, X is equal to zero, 1 or 2, and most preferably equal to 1. Since the object of the game is to go out with a pair, and one or more groupings of three of a kind or runs of three, the equation represents all possible numbers of winning combinations. It is intended that all winning hands according to the method of the present invention contain a pair.

Each player has the option of activating player controls which in turn activate a circuit that sends a signal to the CPU, instructing the CPU to "discard" the tile. The video representation of the tile selected by the player is removed from the display. The CPU is programmed to randomly select a video representation of another tile drawn from the remainder of the same randomly shuffled set of tiles from which the original hand was drawn. The player is permitted to continue to activate the player controls to discard a single tile and then have it replaced, until a maximum number of replacement tiles has been electronically dealt. Although the preferred method of play comprises using only one set of tiles, more than one set could be used to play the game.

If, at any time, during play of the game, a video representation of a tile is drawn that is non-numerical, the CPU is programmed to automatically set aside the tile for purposes of scoring and then replace the non-numerical tile with another randomly selected tile. Preferably, two non-numerical "Mah Jongg" flower tiles are provided. These tiles serve as multipliers. What is meant by a "multiplier" is a tile which enhances the payout of a hand, does not have a face value in itself and is not used to determine the composition of the underlying hand. A multiplier according to the present invention does not always multiply a point total by an integer. Rather, it is an indication that the point value of that hand will be increased in some predetermined way. In a preferred embodiment, the flower tiles multiply winnings by an integer. This procedure is repeated whenever a non-numerical tile is dealt, regardless of the phase of play.

A number of predetermined winning arrangements of tiles is determined in advance of the play of the game. These values are stored in the CPU. The arrangements are selected based on the number of suits in each set of tiles, the number of tiles in each suit with a numeric value, the number of tiles dealt to the player, the number of tiles that can be replaced in each hand and the permitted house profits. The non-numerical video representations of tiles enhance the payouts on the hands which have been determined in advance as winning arrangements.

Upon placing a wager, the CPU causes the visual display to randomly select and show a preselected number of video representations of tiles. The player is permitted to select a maximum number of tiles to discard, depending upon the game rules being followed. After the player has been given the opportunity to discard one tile, the tile is replaced with a randomly selected tile from the same set of tiles from which the original tiles were dealt. This manner of play proceeds until the player has reached a maximum predetermined number of tiles he may discard, or to the point where he wishes to hold. According to the most preferred method of the present invention, the visual display shows five tiles, and the player is permitted to discard up to two tiles, one tile at a time. At the conclusion of play, the CPU compares his hand to a number of predetermined winning tile arrangements, and the player is paid if a winning hand is achieved.

Figure 2:
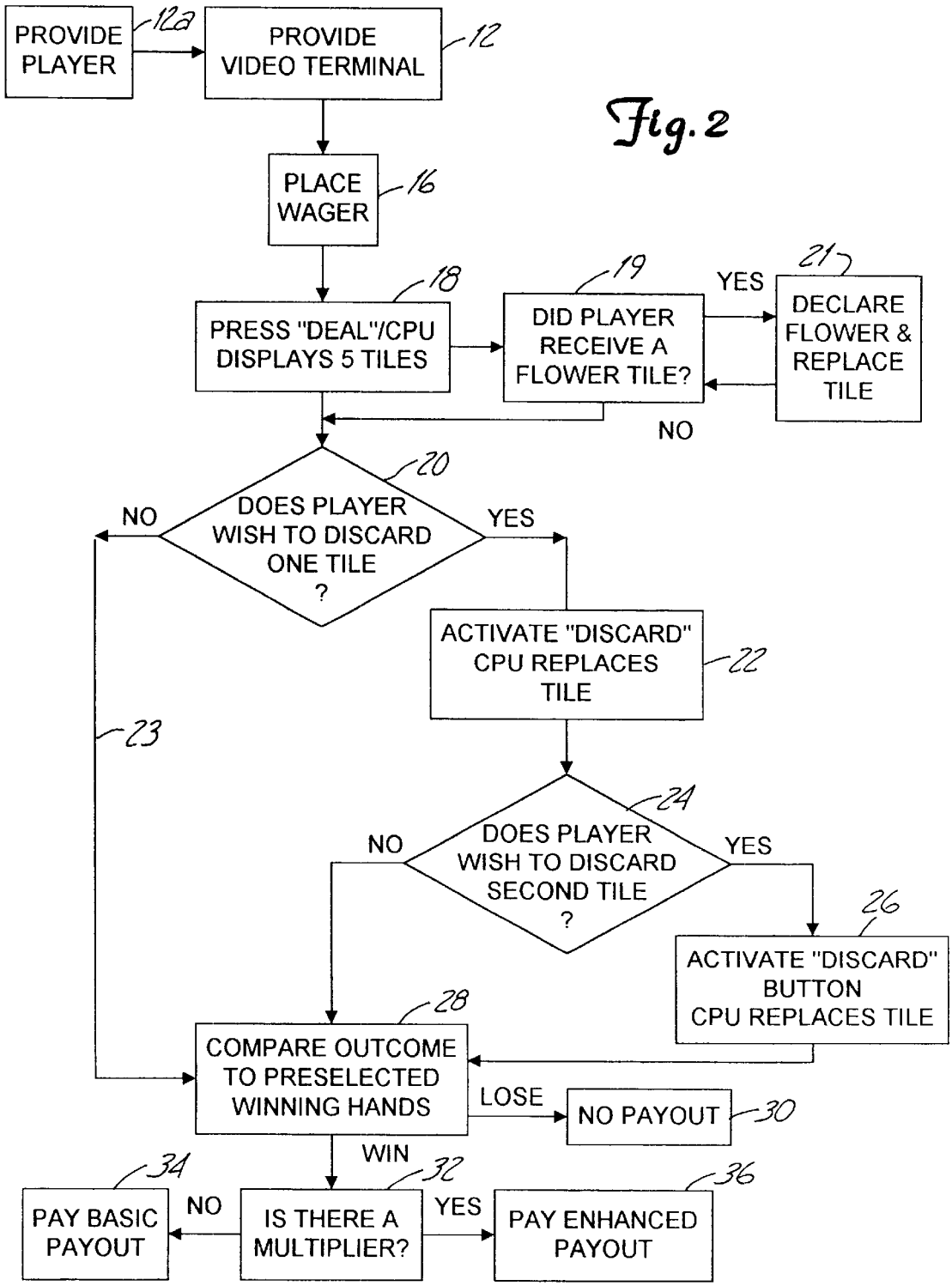
FIG. 2 is a flow diagram illustrating a preferred embodiment of the method of video wagering of the present invention.

FIG. 2 is a block diagram of the preferred method of play of the video wagering game of the present invention. A player 12*a* is provided, as well as a video terminal 12. The video terminal includes a cabinet. A CPU is located in the cabinet (not shown). The CPU is programmed to display video images of certain Mah Jongg tiles. Play begins when a player places a wager 16.

Preferably, the player activates a player control called the "deal" button which causes the CPU to display a video image of five tiles 18. If a flower is displayed 19, the CPU replaces the flower tile with another randomly selected tile 21. If an additional flower tile is displayed, the CPU again sets the tile aside and randomly selects a new tile. The steps of setting flower tiles aside and having them replaced with a randomly selected tile is repeated until the player holds a hand of five tiles each with numerical values.

A player can optionally select a tile to discard 22 which activates the CPU to replace the tile. In the preferred method of play, the player then decides whether to discard a second tile 24. If a second tile is discarded, the CPU replaces the tile 26 with a new tile. Preferably, a maximum of two tiles may be discarded from a five tile hand. The player is free however to play the tiles which were initially dealt without discarding any tiles, according to the present invention. It should be noted that removing flower tiles from the hand is not considered "discarding" a tile according to the present invention.

The present invention contemplates different hand counts and different maximum discard counts. Although the preferred values are 5 and 2, respectively, one might select an eight tile hand and allow the player to discard up to five tiles.

Winning hands are predetermined in accordance with the method of the present invention. In the most preferred embodiment, the following preselected hands comprise winning combinations: three of a kind and a pair, and a run and a pair. The following pay table corresponds to the most preferred predetermined winning hands and payout values per coin or credit wagered, when less than the maximum permissible bet is placed:

TABLE I

| Hand | No flower | 1 flower | 2 flowers |
|---|---|---|---|
| three 1's plus two 9's | 25 | 50 | 250 |
| three 9's plus two 1's | 25 | 50 | 250 |
| any three of a kind with a pair of 2's, 5's or 8's | 7 | 14 | 28 |
| any three of a kind and pair | 4 | 8 | 16 |
| any run a pair of 2's, 5's and 8's | 2 | 6 | 12 |
| any run and any pair | 1 | 3 | 6 |

where a "run" is defined as three tiles of the same suit in sequential order. Examples include 5, 6 and 7 bamboo tiles or 2, 3, and 4 bamboo tiles. The numbers on the above table indicate payout values per coin or credit wagered programmed into the CPU, and not absolute payout values. For example, if a player obtained a hand of three 1's and two 9's on an initial bet of 2 coins or credits, and did not draw any unsuited tiles which in the preferred embodiment are "flower" tiles, the winning amount would be 50 coins or credits.

In another example, the player bets the maximum allowable coins, which in the preferred embodiment is five coins. The following predetermined winning combinations and payout values per coin or credit wagered preferably apply in the case where the maximum bet was placed:

TABLE II

| Hand | No flower | 1 flower | 2 flowers |
|---|---|---|---|
| three 1's plus two 9's | 25 | 50 | 800 |
| three 9's plus two 1's | 25 | 50 | 800 |
| any three of a kind with a pair of 2's, 5's or 8's | 7 | 14 | 28 |

TABLE II-continued

| Hand | No flower | 1 flower | 2 flowers |
|---|---|---|---|
| any three of a kind and pair | 4 | 8 | 16 |
| any run with a pair of 2's, 5's and 8's | 2 | 6 | 12 |
| any run and any pair | 1 | 3 | 6 |

It is to be understood that numerous combinations of tiles may be defined as winning combinations, and endless possibilities of payouts are also possible.

The preferred method of the present invention as illustrated above includes electronically comparing an outcome 28 of each player hand to the preselected winning combinations in order to determine if the player is eligible to win a payout. If the hand is not a winning hand, the player loses 30, and the player either stops playing, or begins a new hand. If the hand is a winning hand, it must be determined if the player drew one or more non-numerical tiles 32, which in the preferred embodiment are preferably flower tiles. If there are no flower tiles in the hand, the payout is found in the first column of the payout schedule described above, and a basic payout 34 is awarded. If the player holds one or more flower tiles, the payout is enhanced 36. If the player holds one flower tile, the payout is in accordance with column two, above and if the player holds two flower tiles, the payout is further enhanced and follows the payout schedule of the third column. The CPU applies the appropriate payout value to the basic bet to calculate a payout, depending on whether or not the maximum bet was placed.

As can be seen from the arrow 23 exiting the box marked on the flow diagram, the player is free to decide to refrain from discarding tiles 20 and proceed directly to having the outcome of the hand decided 28 by the CPU. The CPU calculates a payout when a winning hand is achieved. The payout can be in the form of credits or the player can activate a "cash out" control to collect his payout.

Figure 3:
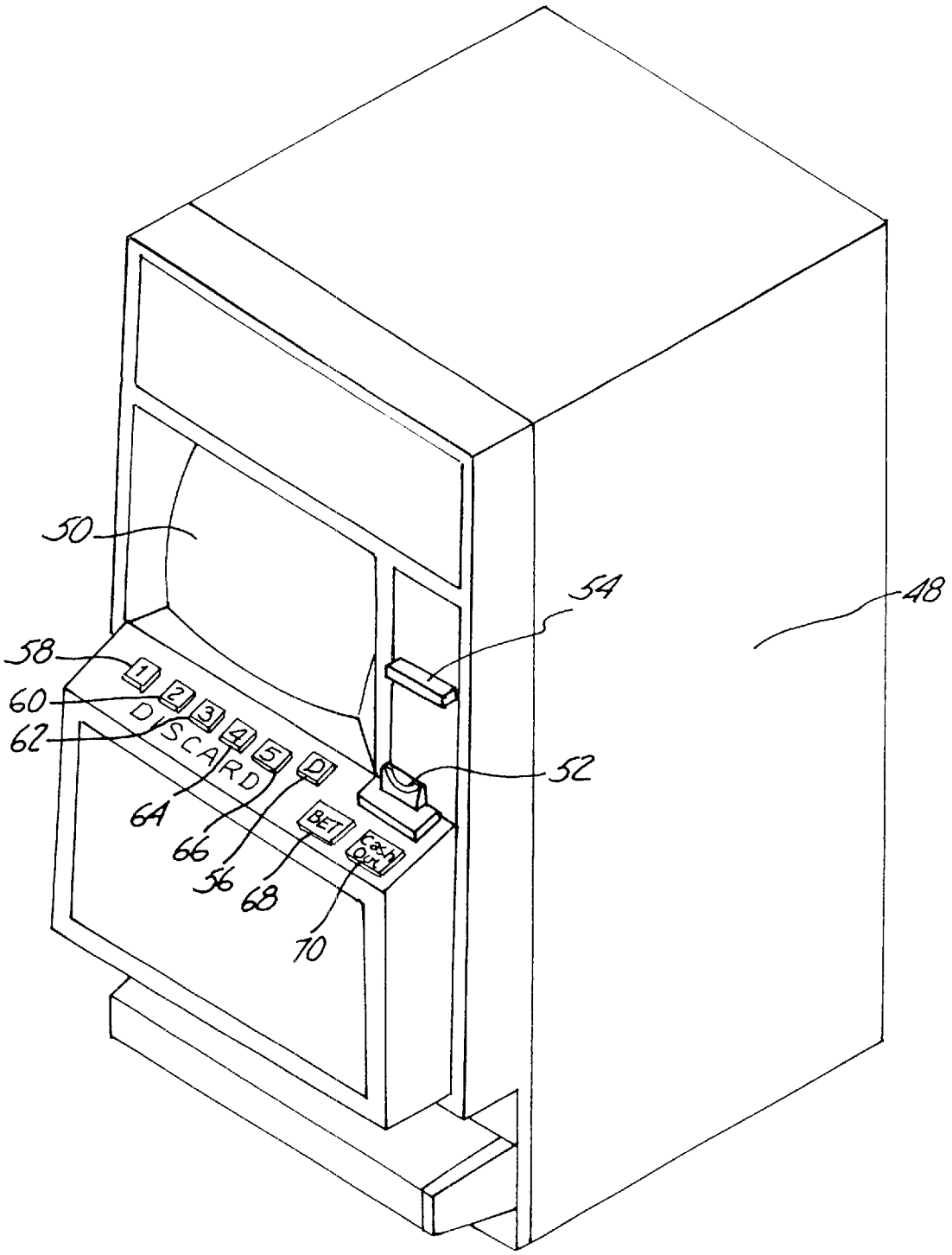
FIG. 3 is a perspective view of a video device which incorporates the method of the present invention.

A device for playing the video version of the game of the present invention is shown in FIG. 3. One of the biggest advantages of providing a video version of the game is in its scoring. The scoring for each hand is automatic, and since the preselected winning combinations of a Mah Jongg-like game are not as familiar to video game players as in other games such as video poker for example, it is not necessary to understand precisely how the game is scored in order to play. For example, a player might walk up to a video terminal 48, and read a short explanation of the object of the game, and begin playing without an awareness of the relative rankings of the various hands.

As shown in FIG. 3, preferably, the video terminal 48 is of the type that is suitable for a single video game, or for playing multiple video games. The terminal 48 has a visual display which preferably is a cathode ray tube 50. The terminal 48 includes a coin drop 52 and a bill receiver 54. Preferably, the terminal includes a device for registering bets, and a device for crediting amounts won and or deposited into either coin drop 52 or bill receiver 54.

The terminal is equipped with a "deal" button 56 and five discard buttons, 58, 60, 62, 64 and 66. Optionally, the buttons can be labeled tile 1, 2, 3, 4, and 5 to designate the tile to be discarded. The player indicates which tiles should be discarded by depressing the discard button beneath the tile he wishes to discard. Once the player has decided on the discard and depresses the deal button, a signal is sent to the CPU within the cabinet which is programmed to automatically replace the tile with another tile randomly selected from the same set of tiles. If a player selects a tile to discard and changes his mind, he can depress the discard button again to reverse the selection.

If a player happens to be dealt a flower tile, the CPU is programmed to move the video display of the tile to a different area on the display and replace the tile with another tile without any action required by the player.

Preferably, the CPU (central processing unit) (not shown) housed within the interior of the video terminal 48 controls the operation of the game, and provides screen displays. The CPU is electronically connected to the control buttons 56, 58, 60, 62, 64 and 66, as well as the output signal from the coin drop 52 and bill acceptor 54. As stated above, the CPU randomly selects tiles, replaces discarded tiles, moves flower tiles to a separate area of the display, tracks bets, credits wins and calculates winning amounts. The video terminal 48 preferably includes a device for generating a signal which indicates that a bet has been placed. In this example, depressing a bet button 68 activates a circuit which in turn sends a signal to the CPU that a bet has been placed. Upon receipt of the signal, the CPU registers the bet. The player can preferably bet one to five coins. For example, if the machine is set up to accept quarter bets, the minimum bet might be one quarter, while the maximum bet may be a dollar twenty-five (U.S. currency). Although this is the preferred method of video wagering, the maximum and minimum bets could easily be modified. For example, the machine could be set up such that the minimum bet was one dollar and the maximum bet were three dollars.

A means for indicating that the player wishes to place the maximum bet (not shown) could also be provided. In the preferred example, the player depresses the bet button 68 once for every coin he wishes to bet. In the preferred example, the maximum bet is 5 coins. The player would simply depress the bet button 68 five times to place the maximum bet. In another example, a "bet credits" button is provided to give the player the option of playing his credits rather than insert more coins. According to the most preferred device of the present invention, the player automatically plays against credits until he either runs out of credits or wishes to cash out. A cash out 70 button is provided to collect winnings.

Figure 4:
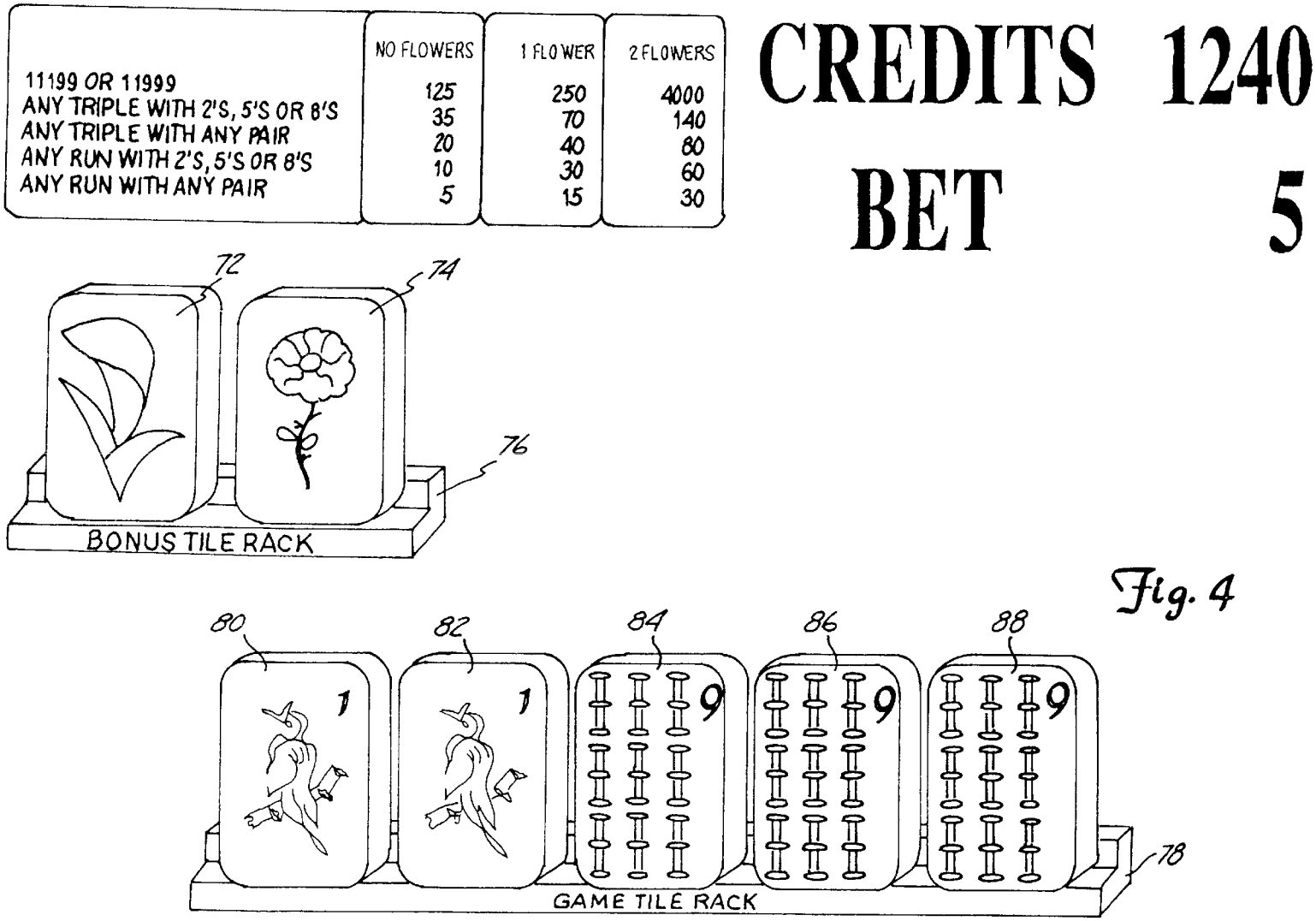
FIG. 4 is an example of a video screen display of the video game of the present invention.

FIG. 4 is an example of a preferred screen display for the video version of the preferred embodiment of the present invention. The lucky player has drawn two flower tiles 72 and 74 which are multipliers and function to enhance the payout of the hand. The flower tiles are placed in a separate "bonus rack" 76 which preferably is a separate rack from the game tile rack 78. The winning hand in this example consists of a "pillow" of ones 80 and 82, and three nines 84, 86 and 88. (The tiles with a face value of ones are in fact bamboo, even though the preferred tiles include symbols which include a bird sitting on a bamboo twig).

The display clearly identifies the most preferred predetermined winning arrangements of tiles, and an example of calculated payouts, based on the amount bet. The display shows absolute payouts when zero, one or two flowers tiles drawn for a given bet. In this example, two flower tiles 72 and 74 enhance the payout of the hand shown and pay at a rate of 800 for 1. Since the bet was five coins, the calculated payout for this winning hand is 4,000 coins. According to present invention, enhanced payouts are available regardless of whether the player has bet the maximum bet. In other words, drawing the flower tiles enhances the payout of winning hands regardless of the amount wagered on the hand. Versions of the game that pay a fixed amount regardless of the size of the wager is also contemplated by the present invention.

In another embodiment of the present invention, the pay table is altered so that one of the predetermined arrangement of tiles is selected which hits infrequently enough to allow for a progressive payout. A portion of the coins bet is apportioned to a jackpot pool and optionally a number of video terminals are electronically hooked together. Combining the jackpot pool of a plurality of machines allows the jackpot to grow more rapidly, increasing player appeal. In another embodiment of the video method of the present invention, an optional or mandatory side bet is incorporated into the game. The side bet funds a progressive jackpot which is paid when a preselected arrangement of tiles is achieved. As with all progressive jackpots, it is desirable to electronically link one or more banks of video wagering machines so that the pot grows to higher levels, and more rapidly than would be possible with a single video wagering machine. The present invention contemplates hooking together banks of video wagering machines within a single property, and banks of machines located in different properties.

The wagering game of the present invention provides a fast moving game having elements which are familiar to players of Mah Jongg, which is easy to play and which can be played at a rate of approximately five hands per minute, which is comparable to the rate of play of conventional video poker. One of the advantages in the video version of the game of the present invention is that the manipulation of the tiles is electronic, and therefore no time is wasted waiting for a dealer to shuffle and otherwise handle the tiles. The player need not be as familiar with the rules of the game to participate. For example, the CPU may be programmed to prompt the player to optionally discard one or both tiles at the appropriate time. The player also need not be familiar with the relative rankings of the hands in the game of the present invention. With only two possible opportunities to replace tiles, the player will simply be working toward a goal of achieving a pillow and a run of any kind or any three of a kind. Other pay tables and winning hands can easily be incorporated into the programming of the CPU to modify the payouts or alter the designated winning tile combinations without confusing the player. In addition, the player does not need to be instructed on what to do with a flower tile when one is dealt, as according to the preferred mode of play, a flower tile is automatically moved to the side and another tile is automatically drawn to replace it. The game is similar enough to its Mah Jongg counterpart that those familiar with that game will be comfortable playing the game of the present invention. Anyone who knows the rules of Mah Jongg will understand the basic rules of the game of the present invention without much additional study.

The present invention contemplates adaptation of the game for play as a live casino wagering game with a dealer and one or more players.

Although the present invention has been described in terms of its preferred embodiments, those skilled in the art will understand that modifications of those described examples are intended to be embraced within the scope of the appended claims.

What is claimed is:

1. A method of playing a wagering game, comprising the steps of:

providing a set of tiles, each set comprising at least one set of suited tiles and at least one non-numerical tile, wherein each suit includes a plurality of tiles which bear an indication of suit and a numerical value, wherein the numerical values are sequential;

the player placing a wager to participate in the game;

dealing a preselected number of tiles equal to 3X+2, wherein X is an integer;

optionally discarding a tile;

dealing a replacement tile;

repeating the discarding and replacement steps until a maximum allowable number of discarded tiles has been reached;

dealing an additional tile if a non-numerical tile is drawn; and paying the player a predetermined amount if a predetermined arrangement of tiles is achieved by the player.

2. The method of claim 1 wherein four identical sets of suited tiles are provided, each suit comprising a tile with a face value of one through nine.

3. The method of claim 1 wherein the suits are bamboo.

4. The method of claim 1 wherein there are two non-numerical tiles.

5. The method of claim 1 wherein the non-numerical tiles are flowers.

6. The method of claim 1 wherein X is 1.

7. The method of claim 1 wherein the maximum allowable number of discarded tiles is two.

8. The method of claim 1 wherein the predetermined arrangements of winning tiles are:

3-1's and 2-9's 2-1's and 3-9's

Any three of a kind with a pair of 2's, 5's or 8's

Any three of a kind with any pair

Any run with a pair of 2's, 5's or 8's

Any run with any pair.

9. The method of claim 1 wherein the predetermined amount is determined from the following payout schedule:

| Combination | No Flowers | 1 Flower | 2 Flowers |
|---|---|---|---|
| two 9's plus three 1's | 25 | 50 | 250 |
| three 9's plus two 1's | 25 | 50 | 250 |
| any three of a kind with a pair of 2's, 5's or 8's | 7 | 14 | 28 |
| any three of a kind and pair | 4 | 8 | 16 |
| any run with a pair of 2's, 5's and 8's | 2 | 6 | 12 |
| any run and any pair | 1 | 3 | 6. |

10. The method of claim 1 wherein the predetermined amount is determined from the following payout schedule for a maximum allowable bet:

| Combination | No Flowers | 1 Flower | 2 Flowers |
|---|---|---|---|
| two 9's plus three 1's | 25 | 50 | 800 |
| three 9's plus two 1's | 25 | 50 | 800 |
| any three of a kind with a pair of 2's, 5's or 8's | 7 | 14 | 28 |
| any three of a kind and pair | 4 | 8 | 16 |
| any run with a pair of 2's, 5's and 8's | 2 | 6 | 12 |
| any run and any pair | 1 | 3 | 6. |

11. A method of playing a video wagering game, comprising the steps of:

providing a player, providing a video wagering terminal comprising a cabinet, a visual display and player controls, each mounted in the cabinet and a CPU positioned within the cabinet, wherein the CPU is programmed to display and permit player manipulation of video representations of tiles from a set of tiles, each set comprising at least one suit, each suit including a plurality of tiles which bear an indication of suit and a numerical value, wherein the numerical values are sequential, and at least one additional non-numerical tile;

the player placing a wager to participate in the game;

the player activating the player controls which signal the CPU and in turn causes the CPU to display a video representation of a preselected number of tiles equal to 3X+2, wherein X is an integer;

the player optionally activating the player controls to signal the CPU which in turn causes the CPU to discard the tile to be discarded and replace with another randomly selected tile from the set;

the player optionally activating the CPU which in turn causes the CPU to discard and replace additional tiles until a maximum allowable number of discarded tiles has been reached;

wherein if a visual representation of a non-numerical tile is drawn, the CPU is programmed to set aside the visual representation of the non-numerical tile for purposes of scoring and replace with a randomly selected tile from the set;

wherein the CPU electronically compares the player's tiles with a group of predetermined winning arrangements of tiles, calculates a winning payout, and assigns a payout to the player when a predetermined winning arrangement of tiles is obtained.

12. The method of claim 11 wherein the video representations of the set of playing tiles comprises four suits of numerically and sequentially ordered tiles, wherein each suit consists of nine tiles.

13. The method of claim 11 wherein there are two non-suited tiles, and wherein the non-numerical tiles are multipliers.

14. The method of claim 11 wherein the player controls comprise a deal button, a plurality of discard buttons, a bet button and a cash out button.

15. The method of claim 11 wherein the payout is progressive.

16. The method of claim 11 wherein a plurality of video wagering machines are electronically connected and the payout is progressive.

17. The method of claim 11, wherein the maximum allowable number of discarded tiles does not exceed the preselected number of tiles.

18. The method of claim 11, wherein the maximum allowable number of discarded tiles is two.

19. The method of claim 12 wherein each suit of tiles is bamboo.

20. The method of claim 11 wherein the non-numerical tiles are flowers.

21. The method of claim 11 wherein there are two non-numerical flower tiles in the set.

22. The method of claim 11 wherein the predetermined arrangement of tiles is selected from the group consisting of: a pair and three of a kind, and a pair and a three tile run.

23. The method of claim 11 wherein the predetermined winning arrangements of tiles are:

3-1's and 2-9's 2-1's and 3-9's

Any three of a kind with a pair of 2's, 5's or 8's

Any three of a kind with any pair

Any run with a pair of 2's, 5's or 8's

Any run with any pair.

24. The method of claim 11 wherein X=1, the maximum number of tiles that can be discarded is two, and the preselected winning combinations of tiles and corresponding payout odds are made according to the following pay table:

| Combination | No Flowers | 1 Flower | 2 Flowers |
|---|---|---|---|
| two 9's plus three 1's | 25 | 50 | 250 |
| three 9's plus two 1's | 25 | 50 | 250 |
| any three of a kind with a pair of 2's, 5's or 8's | 7 | 14 | 28 |
| any three of a kind and pair | 4 | 8 | 16 |
| any run with a pair of 2's, 5's and 8's | 2 | 6 | 12 |
| any run and any pair | 1 | 3 | 6. |

25. The method of claim 11 wherein X=1, the maximum number of tiles that can be discarded is two, and the preselected winning combinations of tiles and corresponding payout odds when a player places a maximum bet are:

| Combination | No Flowers | 1 Flower | 2 Flowers |
|---|---|---|---|
| two 9's plus three 1's | 25 | 50 | 800 |
| three 9's plus two 1's | 25 | 50 | 800 |
| any three of a kind with a pair of 2's, 5's or 8's | 7 | 14 | 28 |
| any three of a kind and pair | 4 | 8 | 16 |
| any run with a pair of 2's, 5's and 8's | 2 | 6 | 12 |
| any run and any pair | 1 | 3 | 6. |

26. The method of claim 11 and further comprising a wager payout device mounted in the cabinet, wherein the CPU is programmed to track player credits, register payouts and activate the wager payout device.

27. The Method of claim 11 wherein X is an integer between zero and two.

28. The method of claim 11 wherein X is equal to 1.

29. The method of claim 11 and further comprising a coin drop mounted in the cabinet.

30. A video wagering device comprising:

a cabinet;

a plurality of player controls mounted in the cabinet;

a device for accepting a wager mounted in the cabinet;

a visual display mounted in the cabinet;

a CPU, positioned within the cabinet, wherein the CPU is programmed to display images of 3X+2 tiles from a set of tiles having at least one suit and at least one non-numerical tile, wherein each suit has a plurality of sequentially numbered tiles, wherein the CPU is programmed to set aside any non-numerical tiles drawn and replace the tiles with another randomly selected tile from the set; and upon receiving a signal resulting from manipulation of the player controls, replaces any tiles which have been identified as discards with another randomly selected tile from the set, up to a maximum predetermined number of tiles.

31. The device of claim 30 wherein the controls include a deal button, a plurality of buttons indicative of a players discard selection, a cash out button, and a bet button.

* * * * *